US006179266B1

(12) United States Patent
Hutten

(10) Patent No.: US 6,179,266 B1
(45) Date of Patent: Jan. 30, 2001

(54) COLLAPSIBLE EASEL

(75) Inventor: James E. Hutten, Mason, OH (US)

(73) Assignee: Ghent Manufacturing, Inc., Lebanon, OH (US)

( * ) Notice: Under 35 U.S.C. 154(b), the term of this patent shall be extended for 0 days.

(21) Appl. No.: 09/358,518

(22) Filed: Jul. 22, 1999

(51) Int. Cl.[7] ..... F16M 11/32; A47B 97/08

(52) U.S. Cl. ..... 248/465; 248/169; 248/440

(58) Field of Search ..... 248/440, 434, 248/435, 169, 168, 163.1, 171, 465; 403/109.3, 109.8, 326, 329, 109.1, 109.2, 170, 169, 172, 180, 327

(56) References Cited

U.S. PATENT DOCUMENTS

| | | | | |
|---|---|---|---|---|
| 2,064,232 | | 12/1936 | Tepper . | |
| 2,613,901 | * | 10/1952 | Tatar | 248/434 |
| 2,668,682 | * | 2/1954 | Dalton | 248/169 |
| 2,709,560 | * | 5/1955 | Resk | 248/169 |
| 2,744,712 | | 5/1956 | Brandt . | |
| 2,973,933 | | 3/1961 | Howell . | |
| 2,982,586 | * | 5/1961 | Gliebe | 403/109.8 |
| 3,038,690 | * | 6/1962 | Alexiou | 248/434 |
| 3,201,080 | | 8/1965 | Rose . | |
| 3,697,031 | * | 10/1972 | Glickman et al. | 248/171 |
| 4,016,806 | * | 4/1977 | Cattermole | 248/168 |
| 4,029,279 | * | 6/1977 | Nakatani | 403/109.8 |
| 4,171,116 | * | 10/1979 | Carver et al. | 248/169 |
| 4,174,900 | * | 11/1979 | Ina | 403/109.1 |
| 4,215,839 | * | 8/1980 | Gibran | 248/171 |
| 4,317,552 | * | 3/1982 | Weidler | 248/168 |
| 4,324,477 | * | 4/1982 | Miyazaki | 248/163.1 |
| 4,378,100 | * | 3/1983 | Minozzi et al. | 248/440 |
| 4,609,174 | * | 9/1986 | Nakatani | 248/168 |
| 4,671,479 | * | 6/1987 | Johnson et al. | 248/173 |
| 4,712,756 | * | 12/1987 | Kester et al. | 248/165 |
| 5,139,040 | * | 8/1992 | Kelly | 135/69 |
| 5,503,357 | * | 4/1996 | Johnson et al. | 248/169 |
| 5,518,217 | * | 5/1996 | Deutsch et al. | 248/463 |
| 5,624,097 | * | 4/1997 | Potter | 248/464 |

* cited by examiner

*Primary Examiner*—Ramon O. Ramirez
*Assistant Examiner*—Jon Szumny
(74) *Attorney, Agent, or Firm*—Jacox, Meckstroth & Jenkins

(57) ABSTRACT

All of the components of a collapsible easel are formed of a rigid plastics material and include three telescopic legs each formed by an upper inner leg section or channel slidable within a lower outer leg section or channel having opposing flanges for retaining the upper leg channel. The top end portions of the upper leg channels are connected to a connector member which forms snap-fit pivotal connections with the leg channels, and the bottom end portions of the upper leg channels have snap-fit pivotal connections to the outer end portions of corresponding leg support members or channels. Another connector member forms snap-fit pivotal connections to the inner end portions of the leg support channels, and the lower end portions of the upper leg channels have integrally molded spring finger lock buttons which snap-fit into selected holes within the lower leg channels. Pivotal support fingers are retained within slots within two lower leg channels by the corresponding upper leg channels.

17 Claims, 2 Drawing Sheets

30
23
80
10
12
12
16
16
72
55
30
72
46
46
55
14
14
46
18
46
46
18
18

23
30
16
23
72
72
46
46
10
12
12
14
14
30
46
46
18

FIG-3
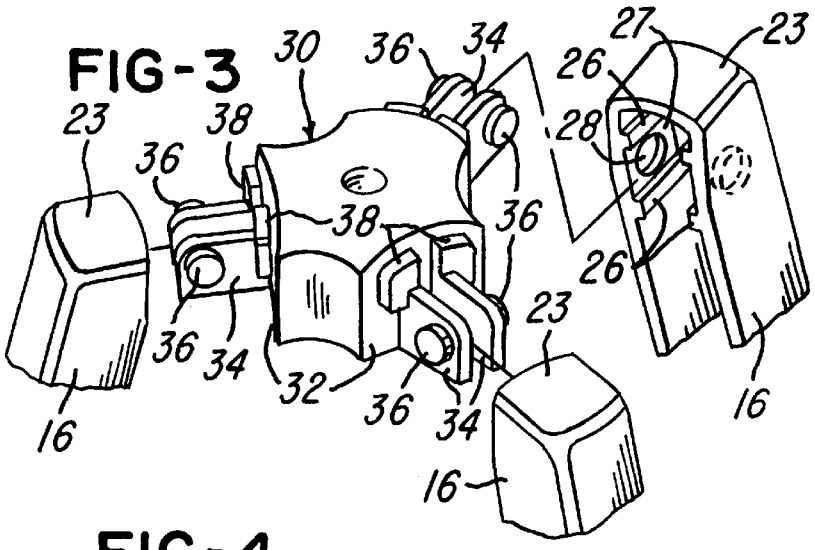
FIG-4
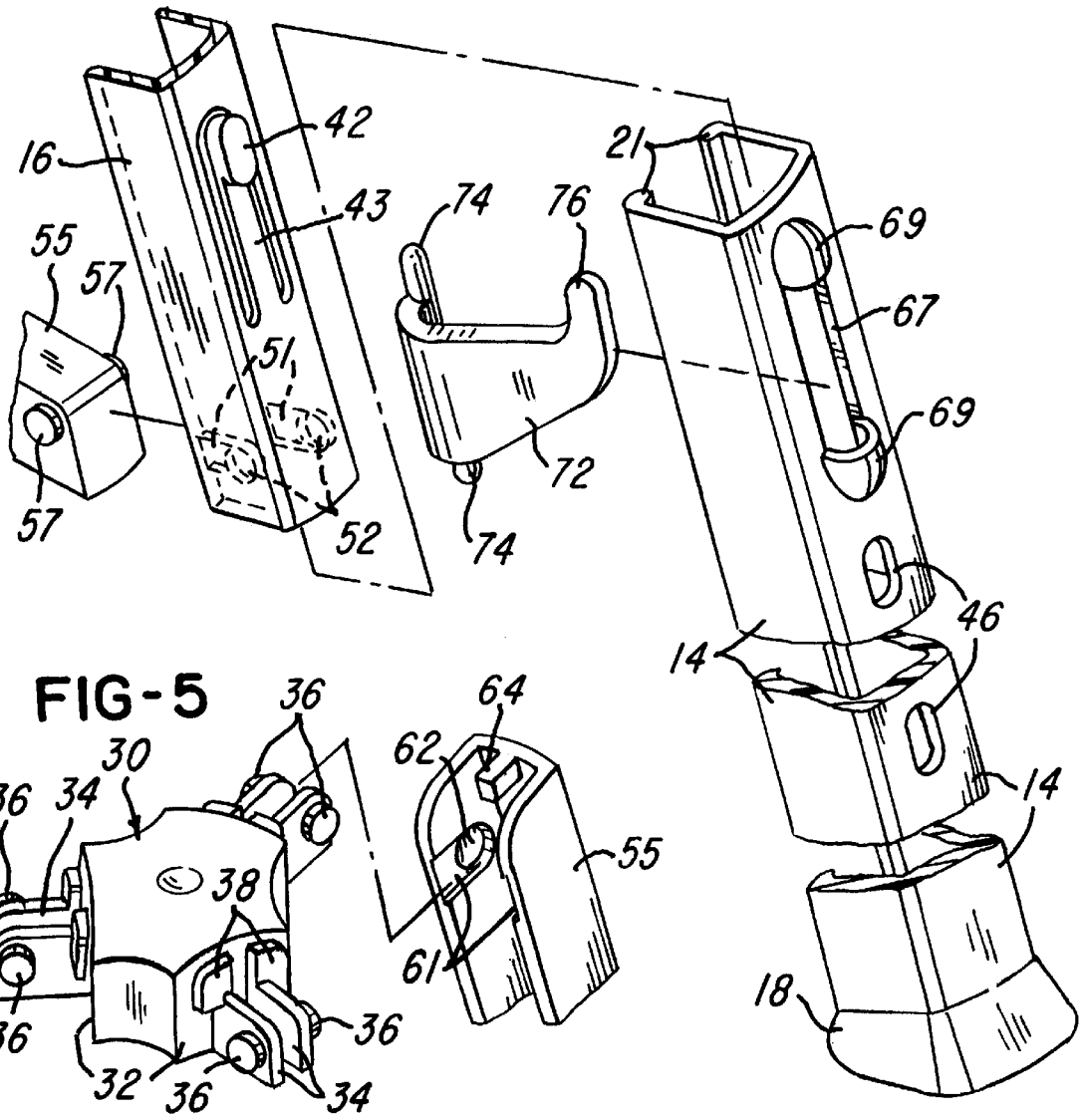
FIG-5

COLLAPSIBLE EASEL

BACKGROUND OF THE INVENTION

The present invention relates to a collapsible easel of the general type disclosed in U.S. Pat. Nos. 2,064,232, 2,744,712, 2,973,933 and 3,201,080. Commonly, such easels incorporate foldable telescopic leg members each having two or more cylindrical leg sections each formed of tubular metal. The upper end portions of the upper tubular leg sections are pivotally connected to a head member which provides for folding the telescopic leg members between generally parallel collapsed positions and outwardly inclined erected positions. The lower tubular leg sections usually telescoped within the upper tubular leg sections which carry threaded clamping fittings which provide for selecting the height of the easel.

Adjustable board support clamps are mounted on two of the upper leg sections, as shown in three of the above patents, and pivotal braces or flexible links are used for stabilizing the leg members in their extended and inclined or erected positions. With any such collapsible easel, it is desirable for the easel to have light weight but provide high support strength, especially when the easel is used to support heavy boards or paintings. It is also desirable for the easel to be economically constructed and be designed for fast assembly in addition to being user friendly, that is, be simple to set up and collapse.

SUMMARY OF THE INVENTION

The present invention is directed to an improved and simplified collapsible easel which provides all of the desirable features mentioned above and which also eliminates any problem of corrosion between tubular metal or aluminum leg components or with their fasteners. In accordance with a preferred embodiment of the invention, a collapsible easel is constructed entirely of components which are injection molded of substantially rigid plastics material, and the components may be quickly assembled without using separate fasteners such as screws or bolts.

The easel of the invention preferably includes three telescopic legs each having an upper and inner leg section or channel which telescopes within a lower outer leg section or channel having opposing return lips or flanges which confine the upper leg channel for sliding movement. The top end portions of the upper inner leg channels are pivotally connected to a connector member having a pair of spaced ears with integral pivot studs projecting laterally outwardly into cavities within each upper leg channel. The lower end portion of each upper leg channel is molded with an integral spring lock button and with inner cavities for receiving pivot studs on the outer end of a corresponding leg support member or channel.

The inner end portions of the three leg support channels are pivotally connected to another connector member which cooperates to permit simultaneous movement of the leg members between generally parallel collapsed positions and outwardly inclined supporting or erected positions. Each of the lower leg channels also has a set of holes for selectively receiving the lock buttons for retaining the leg members in selected retracted or extended positions. The upper portions of the outer leg channels are also provided with slots for receiving a pair of pivotal board support fingers which are retained by the corresponding inner leg channels.

Other features and advantages of the invention will be apparent from the following description, the accompanying drawings and the appended claims.

BRIEF DESCRIPTION OF THE DRAWINGS

FIG. 3 is an exploded and fragmentary perspective view of the upper end portion of the easel shown in FIG. 1;

FIG. 4 is an exploded and fragmentary perspective view of a telescopic leg member shown in FIG. 1; and FIG. 5 is an exploded and fragmentary perspective view of a leg support channel and the connector member for the leg support channels, shown assembled in FIG. 1.

DESCRIPTION OF THE PREFERRED EMBODIMENT

Figure 1:
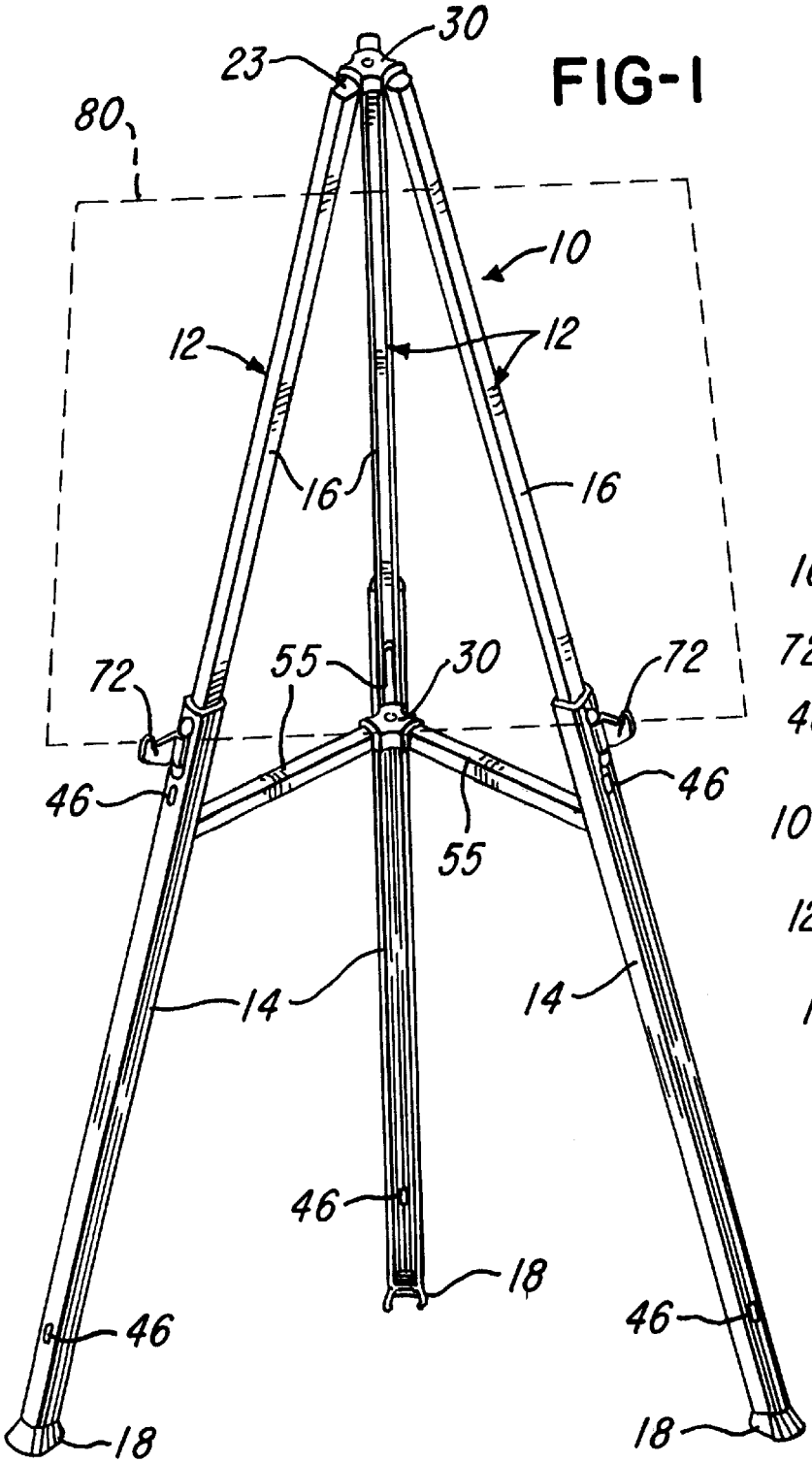
FIG. 1. is a perspective view of a collapsible easel constructed in accordance with the invention and illustrated in its extended and erected position.

A collapsible easel 10 includes three telescopic leg members 12 each of which includes a lower outer leg section or channel 14 and an upper inner leg section or channel 16. Both of the leg channels 14 and 16 are injection molded of a rigid plastics material, and each lower outer leg channel 14 includes a flared bottom foot portion 18 and a pair of longitudinally extending and opposing ribs or flanges 21 (FIG. 4) which retain the corresponding upper inner leg channel 16 for sliding telescopic movement.

Referring to FIG. 3, the upper end portion of each inner leg channel 16 has a closed top end wall 23, and each side wall of the leg channel has a pair of parallel spaced internal ribs 26 separated by a tapered cam surface 27 which extends to a cylindrical cavity 28. Each of the upper leg channels 16 is pivotally connected to a hollow head or connector member 30 which is also molded of the rigid plastics material. The connector member 30 has three uniformally spaced flat side walls 32, and a pair of parallel spaced ears 34 project outwardly from each side wall 32. A cylindrical pivot stud 36 projects laterally outwardly from each ear 34, and a pair of stop lugs 38 also project outwardly from each side wall 32 above the ears 34. As apparent from FIG. 3, when the upper end portion of each inner leg channel 16 is pressed onto the ears 34 of the connector member 30, the cam surfaces 27 squeeze the ears 34 together slightly until the pivot studs 36 snap-fit into the corresponding cavities 28. The leg channels 16 are then free to pivot with respect to the connector 30 between collapsed positions (FIG. 2) and outwardly inclined supporting or erected positions (FIG. 1) where the end wall 23 of each leg channel 16 engages the corresponding stop lug 38.

The lower end portion of each inner leg channel 16 is molded with an integral lock button 42 projecting outwardly from a spring finger 43 molded as part of the leg channel. The lock button 42 is adapted to snap into one of a plurality of slots 46 (FIG. 4) formed within the corresponding outer leg channel 14. When the upper leg channel 16 is fully retracted in its corresponding lower leg channel 14 (FIG. 2). the lock button 42 snaps into the slot 46 within the lower end portion of the leg channel 14. When the upper leg channel 16 is fully extended from its corresponding lower leg channel 14 (FIG. 1), the lock button 42 snaps into the uppermost slot 46 within the corresponding leg channel 14.

As shown in FIG. 4, the bottom end portion of each upper leg channel 16 is also provided with a pair of opposing internal cam surfaces 51 which extend from corresponding internal cylindrical cavities 52 (FIG. 4). A leg support channel 55 is provided for each of the leg members 12, and the outer end portion of each support channel 55 is molded with a pair of laterally projecting cylindrical pivot studs 57 (FIG. 4). Each of the leg support channels 55 is pivotally connected to the lower end portion of its corresponding upper leg channel 16 by pressing the pivot studs 57 into the cam surfaces 51 causing the side walls of the leg channel to spread until the pivot studs 57 snap into the corresponding cavities 52.

Referring to FIG. 5, the inner end portions of the leg support channels 55 are each pivotally connected to another connecting member or connector 30 which is substantially or identical to the top or head connecting member or connector 30. The inner end portion of each leg support channel 55 is also provided with a pair of opposing inclined cam surfaces 61 which extend to corresponding cylindrical cavities 62 for receiving the corresponding studs 36 to form a snap-fit pivot connection with the cavity 62. This connection provides for pivoting the leg support channels 55 between generally parallel collapsed positions (FIG. 2) and generally horizontal erected positions (FIG. 1).

The upper end portion of each leg support channel 55 also has an integrally molded lug 64 (FIG. 5) which projects between the corresponding ears 34 when the leg support channel 55 is pivoted to its horizontal position. The lug 64 prevents the leg support channel 55 from being disconnected from the connector 30 when the leg support channel is in its extended horizontal position. As apparent from FIG. 2, when the easel 10 is in its collapsed position, the leg support channels 55 pivot into their corresponding upper leg channels 16 to provide the easel with compactness.

Figure 2:
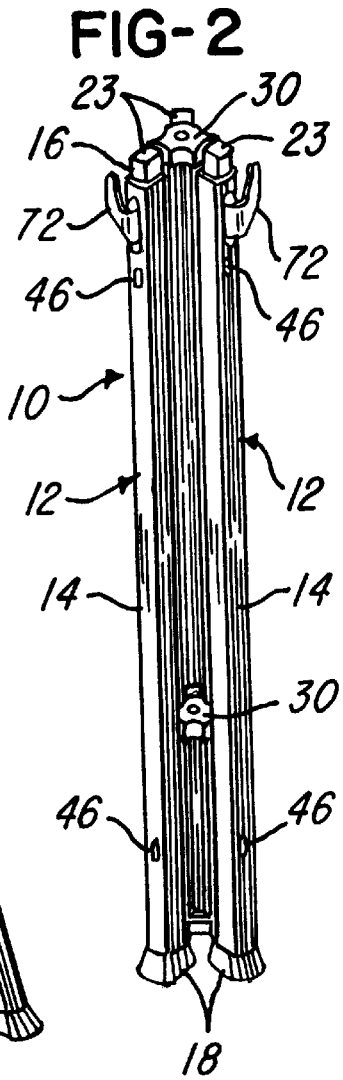
FIG. 2 is a perspective view of the easel shown in FIG. 1 and illustrated in its retracted and collapsed position.

Referring to FIGS. 1 and 4, the upper end portion of each outer leg channel 14 is provided with a slot 67 with a semi-cylindrical and dome-shaped projection 69 at each end of the slot. A pair of right and left board support members or fingers 72 project through the slots 67 within two of the lower leg channels 14, and each support finger 72 has a pair of laterally projecting pivot pins 74 which are received within the corresponding projections 69 at opposite ends of the slot 67. Each support finger 72 is retained within its slot 67 by the corresponding upper and inner leg channel 16. As shown in FIG. 1, the support fingers 72 each have an upwardly projecting outer tip 76 and are used for supporting a picture or poster or board illustrated by the dotted line 80.

The length of the telescopic leg members 12 in their extended positions (FIG. 1) is sufficient to permit the easel to be supported by a floor surface with the board 80 at eye level. However, the inner and upper leg channels 16 may also be retracted into their corresponding lower and outer leg channels 14 if it is desired to place the easel on a table and hang or suspend the board 80 from the support fingers 72. When the easel 10 is in its collapsed position (FIG. 2), the support fingers 72 may be pivoted to collapsed positions where the fingers are generally in overlapping parallel positions. It is also apparent that each of the outer leg channels 16 may be provided with a plurality of longitudinally spaced slots 67 and corresponding end projections 69 in order to locate the support fingers 72 at different selected positions along the leg channels or within the bottom portions of the leg channels.

From the drawings and the above description, it is apparent that a collapsible easel constructed in accordance with the present invention, provides desirable features and advantages. For example, the all plastic components of the easel 10, including the leg channels 14 and 16, provide for a light weight and high strength construction and eliminate any problem of corrosion which is common with some easels having tubular metal telescopic legs and threaded collars. The injection molded plastic components also provide for an economical construction and for simplified and quick assembly without requiring any machining of any components. The snap-fit connections of the telescopic leg channels 16 and the leg support channels 55 to each other and to the center connectors 30 also provide for quick assembly without the requirement for separate fasteners such as screws and bolts. The easel 10 may also be used on a floor with the inner upper leg sections or channels 16 extended, as shown in FIG. 1, or may be used on a table with the leg sections or channels 16 retracted into their corresponding lower leg sections or channels 14. The lower leg sections 14 also carry the board support fingers 72 so that the weight of a board or picture supported by the fingers 72 is transmitted directly to the floor supporting the easel and not through any releasable fasteners or couplers which connect the telescopic leg sections.

While the form of easel herein described constitutes a preferred embodiment of the invention, it is to be understood that the invention is not limited to this precise form of easel and that changes may be made therein without departing from the scope and spirit of the invention as defined in the appended claims.

What is claimed is:

1. A collapsible easel comprising a set of three elongated leg members each including an elongated upper inner leg section and an elongated lower outer leg section, each of said upper and lower leg sections having a channel-shape cross-sectional configuration, said lower outer leg section of each said leg member having longitudinally extending opposing flanges retaining the corresponding said upper inner leg section for relative sliding telescopic movement between an extended position and a retracted position within said lower outer leg section, a head connector member pivotally connected to an upper end portion of each of said inner leg sections and providing for pivotal movement of said leg members between generally parallel collapsed positions and outwardly diverging erected positions, a set of three elongated leg support members each having an outer end portion pivotally connected to a lower end portion of a corresponding said upper inner leg section and movable to a collapsed position confined within the corresponding said upper inner leg section, and a lower connector member pivotally connected to an inner end portion of each of said leg support members and providing for simultaneously moving said leg members between said collapsed and erected positions.

2. An easel as defined in claim 1 wherein each of said lower outer leg sections of at least two of said leg members supports a board support finger projecting laterally outwardly from said lower leg section for transmitting the weight of a board directly to a floor surface.

3. An easel as defined in claim 2 wherein each of said board support fingers is retained for pivotal movement within a slot within the corresponding said lower leg section by the corresponding said inner leg section.

4. An easel as defined in claim 2 wherein an upper end portion of each said lower outer leg section has an opening receiving a spring bias depressible lock button on a lower end portion of the corresponding said upper inner leg section.

5. An easel as defined in claim 4 wherein each of said spring bias depressible lock buttons is formed as an integral part of the corresponding said inner leg section.

6. An easel as defined in claim 1 wherein said head connector member includes a pair of outwardly projecting and integrally connected spaced ears for each of said upper inner leg sections, a pair of integrally connected pivot studs projecting laterally outwardly from each said pair of ears, and each said inner leg section has and an upper end portion with opposing cavities receiving said pivot studs.

7. An easel as defined in claim 1 wherein said lower connector member includes a pair of outwardly projecting and integrally connected spaced ears for each of said leg support members, a pair of integrally connected pivot studs projecting laterally outwardly from each said pair of ears, and each of said leg support members has a channel-shaped cross-sectional configuration and an inner end portion with opposing cavities receiving said pivot studs.

8. An easel as defined in claim 1 wherein said inner and outer leg sections, said leg support members and said connector members are molded of a rigid plastics material.

9. A collapsible easel comprising a set of three elongated leg members each including an elongated upper inner leg section and an elongated lower outer leg section, each of said upper and lower leg sections having a channel-shape cross-sectional configuration and formed of a rigid plastics material, said lower outer leg section of each said leg member having longitudinally extending opposing flanges retaining the corresponding said upper inner leg section for relative sliding telescopic movement between an extended position and a retracted position within said lower outer leg section, a head connector member pivotally connected to an upper end portion of each of said inner leg sections and providing for pivotal movement of said leg members between generally parallel collapsed positions and outwardly diverging erected positions, a set of three elongated leg support members each having an outer end portion pivotally connected to a lower end portion of a corresponding said upper inner leg section and movable to a collapsed position confined within the corresponding said upper inner leg section, a lower connector member pivotally connected to an inner end portion of each of said leg support members and providing for simultaneously moving said leg members between said collapsed and erected positions, and each of said outer lower leg sections of at least two of said leg members supporting a board support finger projecting laterally outwardly from said lower leg section for transmitting the weight of a board directly to a surface supporting said easel.

10. An easel as defined in claim 9 wherein each of said board support fingers is retained for pivotal movement within a slot within the corresponding said lower leg section by the corresponding said inner leg section.

11. An easel as defined in claim 9 wherein an upper end portion of each said lower outer leg section has an opening receiving a spring bias depressible lock button on a lower end portion of the corresponding said upper inner leg section.

12. An easel as defined in claim 11 wherein each of said spring bias depressible lock buttons is molded as an integral part of the corresponding said inner leg section.

13. An easel as defined in claim 9 wherein said head connector member includes a pair of outwardly projecting and integrally connected spaced ears for each of said upper inner leg sections, a pair of integrally connected pivot studs projecting laterally outwardly from each said pair of ears, and each said inner leg section has an upper end portion with opposing caries receiving said pivot studs.

14. An easel as defined in claim 9 wherein said lower connector member includes a pair of outwardly projecting and integrally connected spaced ears for each of said leg support members, a pair of integrally connected pivot studs projecting laterally outwardly from each said pair of ears, and each of said leg support members has a channel-shaped cross-sectional configuration and an inner end portion with opposing cavities receiving said pivot studs.

15. An easel as defined in claim 14 wherein said inner end portion of each of said leg support members has a portion adapted to project between the corresponding said pair of ears when said leg support member is in a generally horizontal position to prevent flexing of said ears.

16. An easel as defined in claim 9 wherein said, leg support members and said connector members are injection molded of a rigid plastics material.

17. A collapsible easel comprising a set of three elongated leg members each including an elongated upper inner leg section and an elongated lower outer leg section, each of said upper and lower leg sections having a channel-shape cross-sectional configuration, said lower outer leg section of each said leg member having longitudinally extending opposing flanges retaining the corresponding said upper inner leg section for relative sliding telescopic movement between an extended position and a retracted position within said lower outer leg section, a head connector member pivotally connected to an upper end portion of each of said inner leg sections and providing for pivotal movement of said leg members between generally parallel collapsed positions and outwardly diverging erected positions, a set of three elongated leg support members each having an outer end portion pivotally connected to a lower end portion of a corresponding said upper inner leg section and movable to a collapsed position confined within the corresponding said upper inner leg section, a lower connector member pivotally connected to an inner end portion of each of said leg support members and providing for simultaneously moving said leg members between said collapsed and erected positions, said inner and outer leg sections, said leg support members and said head and lower connector members being molded of a rigid plastic material, and each of said outer lower leg sections of at least two of said leg members supporting a board support finger projecting laterally outwardly from said lower leg section for transmitting the weight of a board directly to a surface supporting said easel.

* * * * *